US007674015B2

(12) United States Patent
Chien

(10) Patent No.: US 7,674,015 B2
(45) Date of Patent: Mar. 9, 2010

(54) LED PROJECTOR LIGHT MODULE

(76) Inventor: Chen-Chun Chien, No.157, Dapu Rd., Sansia Township, Taipei County 237 (TW)

( * ) Notice: Subject to any disclaimer, the term of this patent is extended or adjusted under 35 U.S.C. 154(b) by 0 days.

(21) Appl. No.: 11/492,898

(22) Filed: Jul. 26, 2006

(65) Prior Publication Data

US 2007/0230186 A1 Oct. 4, 2007

(30) Foreign Application Priority Data

Mar. 30, 2006 (TW) ..... 95205314 U

(51) Int. Cl.
*F21V 29/00* (2006.01)

(52) U.S. Cl. ..... 362/294; 257/79; 257/81; 257/99; 257/722; 362/362; 165/104.33

(58) Field of Classification Search ..... 257/79, 257/81, 99, 722; 437/906; 362/294, 362; 165/104.33
See application file for complete search history.

(56) References Cited

U.S. PATENT DOCUMENTS 6,340,056 B1 * 1/2002 Huang et al. ..... 165/185
6,367,542 B1 * 4/2002 Chen ..... 165/80.3
6,400,067 B1 * 6/2002 Manning et al. ..... 313/46
6,787,999 B2 * 9/2004 Stimac et al. ..... 315/51
6,903,382 B2 * 6/2005 Ho ..... 257/99
6,974,234 B2 * 12/2005 Galli ..... 362/294
7,111,963 B2 * 9/2006 Zhang ..... 362/294
7,144,135 B2 * 12/2006 Martin et al. ..... 362/294
7,314,291 B2 * 1/2008 Tain et al. ..... 362/294
7,316,487 B2 * 1/2008 Hirata et al. ..... 362/345
2004/0104013 A1 * 6/2004 Yeh ..... 165/104.33
2004/0150955 A1 * 8/2004 Lin ..... 361/709
2005/0174780 A1 * 8/2005 Park ..... 362/294
2006/0193139 A1 * 8/2006 Sun et al. ..... 362/373
2006/0290891 A1 * 12/2006 Wang et al. ..... 353/52
2007/0236935 A1 * 10/2007 Wang ..... 362/294

* cited by examiner

*Primary Examiner*—David Vu
*Assistant Examiner*—Brandon Fox

(57) ABSTRACT

A LED projector light module comprising a main body, a LED unit, a heat-radiating unit, a voltage conversion unit and a base is disclosed. The main body is made of metallic material with good thermal conductivity (e.g. copper) and contains a space for accommodating the LED unit. The LED unit and the voltage conversion unit are electrically connected. The voltage conversion unit is configured inside the base. The base is connectable to the main body. The bottom surface of base is disposed with an electrically conductive pin that matches the projector socket. The electrically conductive pin is electrically connected to the voltage conversion unit at one end. The invention is characterized in which the heat-radiating unit is arranged at the outer rim of main body and the heat generated by the LED unit can be effectively transferred to the heat-radiating unit through the main body and then rapidly dissipate, which enhances the efficiency of heat dissipation, thereby allowing the use of higher wattage LED to enhance luminance.

10 Claims, 6 Drawing Sheets

LED PROJECTOR LIGHT MODULE

BACKGROUND OF INVENTION

1. Field of the Invention

The present invention relates to a LED projector light module, more particularly a kind of LED projector light module that can be directly mounted on a conventional MR-16 socket, uses the light emitted by LED to provide the light source, and has heat-radiating fins disposed at the outer rim of LED.

2. Description of the Prior Art

Projector lamps have long accounted for a certain percentage of the lamp market. Particularly as energy-saving light bulbs are gradually replacing conventional fluorescent tubes, projector lamp remains popular due to the special illumination effect it can create. Projector lamps have been used in home furbishing, showrooms and restaurants to foster unique atmosphere and highlight the products or decorations on display. Given its substantial market scale, the dimensions of projector lamps are already standardized. Conventional projector lamps use 110-volt halogen light bulb A (FIG. 1). Halogen light bulb consumes considerable electricity and tends to get hot. Its service life is relatively short that typically lasts several months. In the age of exorbitantly high oil prices, using halogen light bulb is not only environmentally unfriendly, the high heat it emits also poses hazard, such as short circuit. Conventional halogen light bulb has another drawback that is rarely mentioned. That is, it would release excess amount of ultraviolet radiation, which tends to cause harm to people's eyes or skin and leads to pathological changes if these organs are under the irradiation for a long period of time.

To address the drawbacks of conventional halogen light bulb, industry people once launched a projector lamp that uses light emitting diode (LED), which consumes less energy, as light source. Conventional LED projector light bulb B (FIG. 2) primarily consists of an outer casing C, a voltage conversion unit D and a LED unit E. The LED unit E and the voltage conversion unit D are accommodated inside the metal casing C. The voltage conversion unit D converts the 110-volt alternating current into direct current that can be used by the LED unit E and causes the LED unit E to illuminate and achieve the projection effect. The conventional LED projector light bulb B is more energy-saving in comparison with the conventional halogen light bulb A. But the LED unit E also has heat dissipation problem. To achieve the effect of single-point projection, the LED unit E must achieve certain brightness level. Despite of the rapid advancement of technology that has brought LED brightness to a higher level, the problem of heat dissipation remains. In fact, LED unit E has lower level of thermal resistance in comparison with conventional halogen light bulb A. Once the heat generated surpasses the tolerance level of LED unit E, its brightness will attenuate. Consequently the LED unit E might fail to provide the anticipated effect and have its service life shortened. Nevertheless, the heat dissipation problem of conventional LED projector lamp B has never been dealt with. Thus in actual applications, the heat energy generated while LED unit E works can only be dissipated slowly through metal casing C, which is hardly satisfactory. As a result, the LED projector light bulb B in use at the present time cannot exceed 1 watt, which means the illumination provided by the LED unit E is also limited and makes it a less than ideal candidate to replace the conventional halogen light bulb A. As a result, the high energy consuming, and high heat generating halogen light bulb A still holds onto certain market share and creates significant energy waste.

SUMMARY OF INVENTION

The primary object of the present invention is to provide a LED projector light module, which provides increased heat transfer area through the arrangement of heat-radiating fins to enhance the efficiency of heat dissipation.

Another object of the present invention is to provide a LED projector light module which allows the use of higher wattage LED for enhanced luminance by improving the efficiency of heat dissipation.

A further object of the present invention is to provide a LED projector light module, which, with greatly enhanced luminance, can totally replace the conventional halogen projector lamps, thus saving energy and being environmentally friendly.

Yet another object of the present invention is to provide a LED projector light module, which expands the applications and variation of projector lamps by generating different colors of light with LED.

To achieve the aforesaid objects, a LED projector light module comprising a main body, a LED unit, a heat-radiating unit, a voltage conversion unit and a base is disclosed. The main body is made of metallic material with good thermal conductivity (e.g. copper or aluminum) and contains a space for accommodating the LED unit. The LED unit and the voltage conversion unit are electrically connected. The voltage conversion unit is configured inside the base. The base is connectable to the main body. The bottom surface of base is disposed with an electrically conductive pin that matches the projector socket. The electrically conductive pin is electrically connected to the voltage conversion unit at one end. The invention is characterized in which the heat-radiating unit is arranged at the outer rim of main body and the heat generated by the LED unit can be effectively conducted to the heat-radiating unit through the main body and then rapidly dissipate, thus enhancing the efficiency of heat dissipation.

BRIEF DESCRIPTION OF THE DRAWINGS

The details of the present invention will be more readily understood from a detailed description of the preferred embodiments taken in conjunction with the following figures.

DETAILED DESCRIPTION

Figure 1:
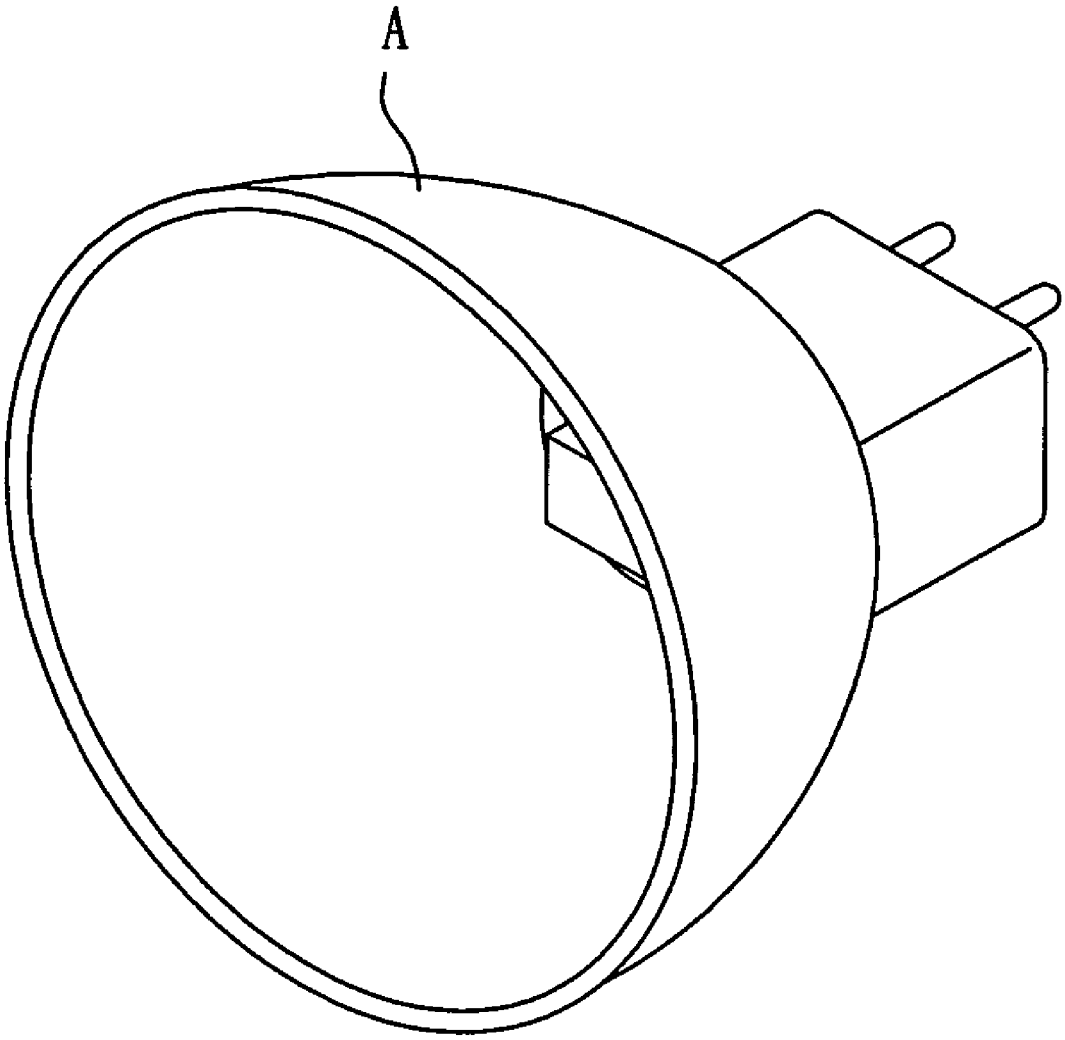
FIG. 1 (PRIOR ART)
FIG. 1 is a diagram showing a conventional halogen projector light bulb.
Figure 2:
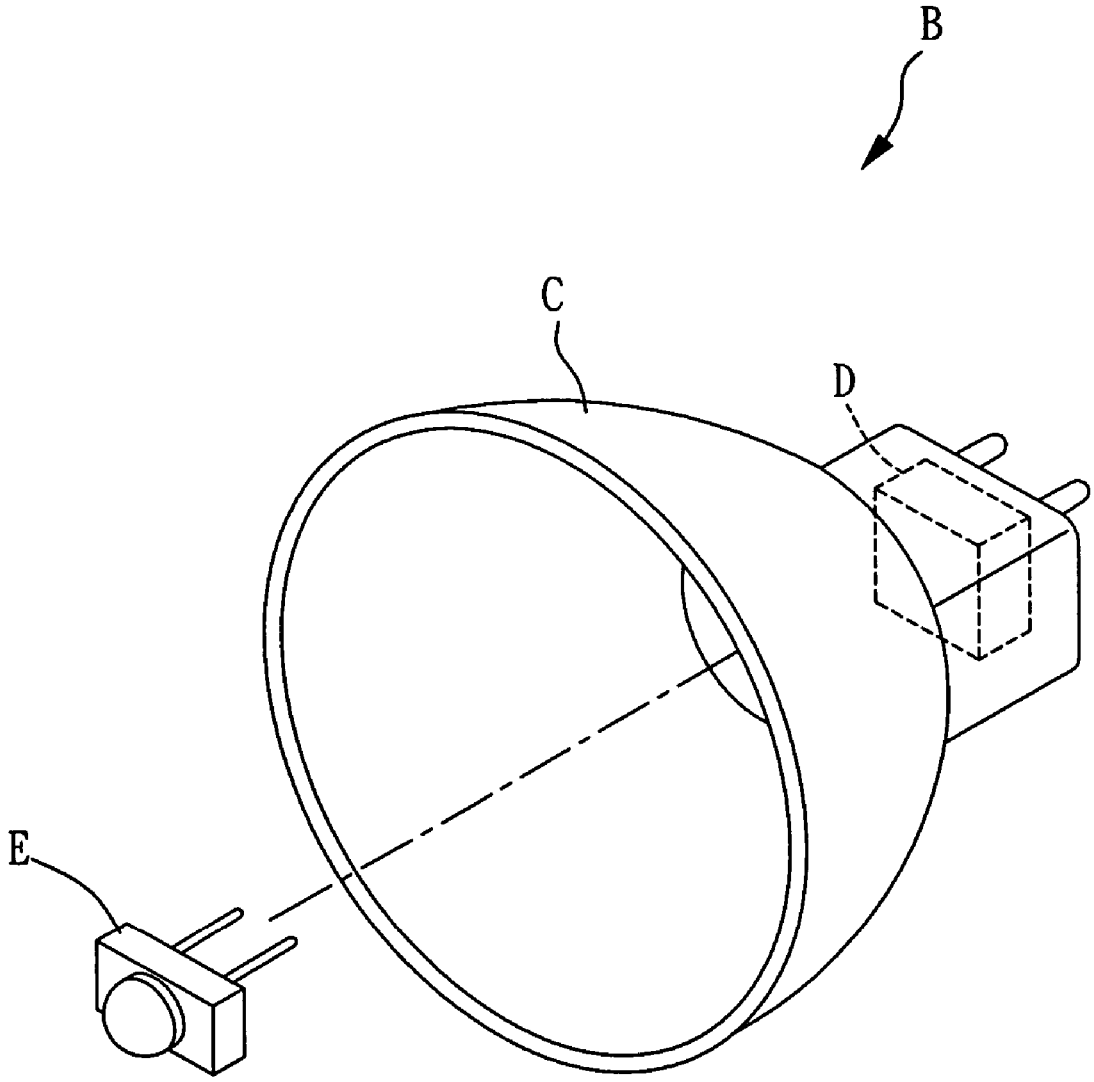
FIG. 2 (PRIOR ART)
FIG. 2 is a diagram showing a conventional LED projector light bulb.
Figure 3:
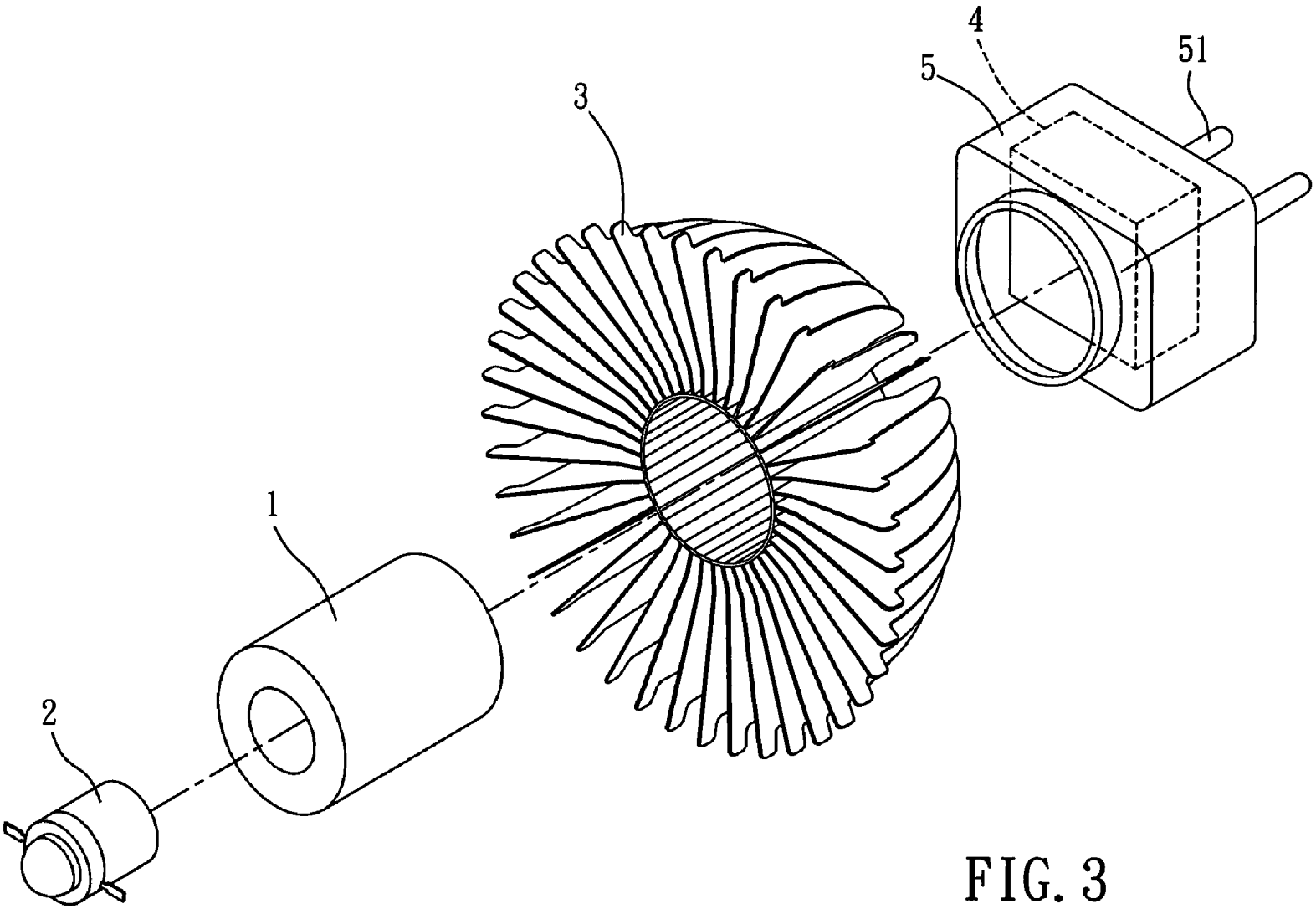
FIG. 3 is an exploded view of the invention.
Figure 4:
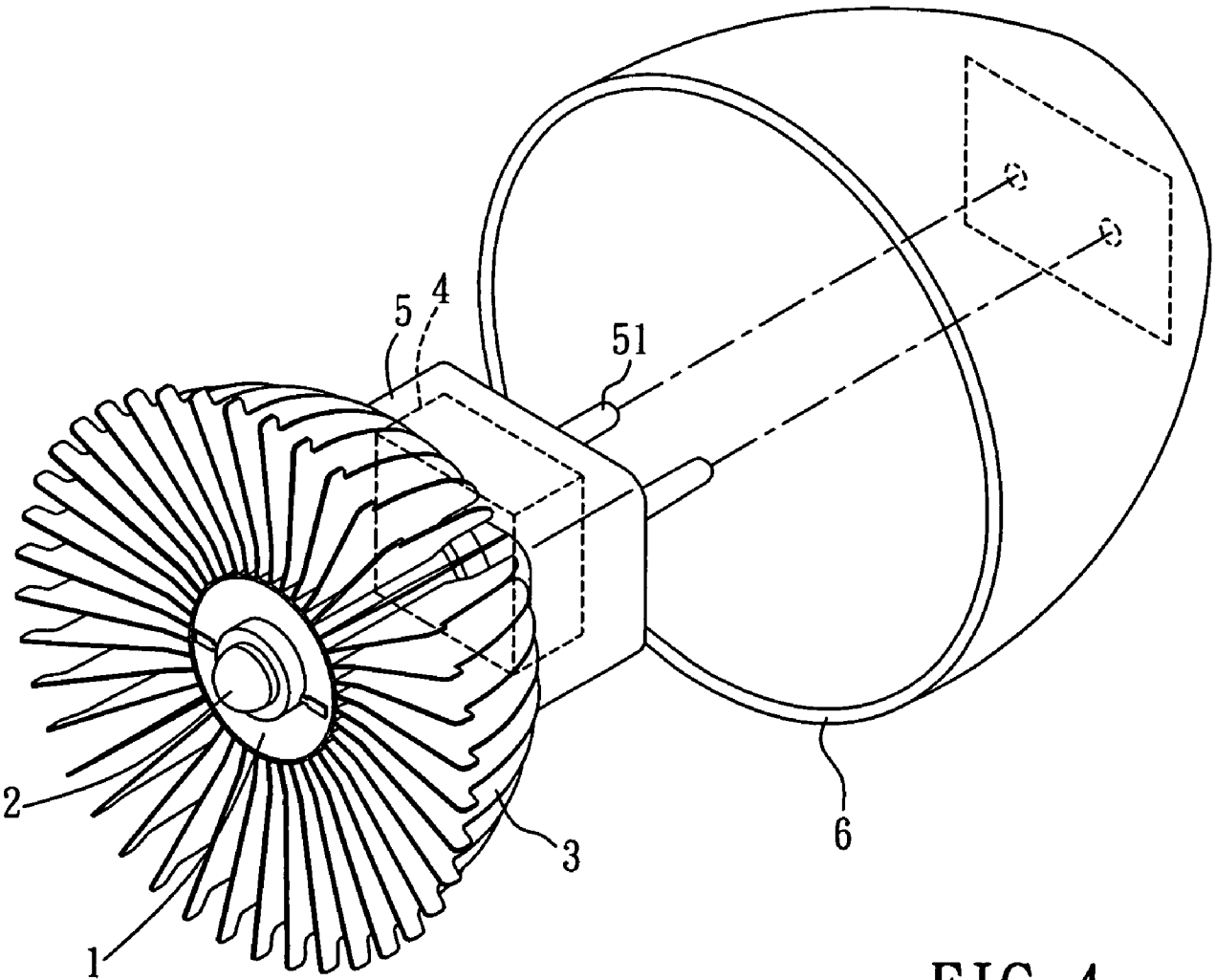
FIG. 4 is an assembled view of the invention.

Referring to FIG. 3 which is an exploded view of the invention, the LED projector light module comprises a main body 1, a LED unit 2, a heat-radiating unit 3, a voltage conversion unit 4, and a base 5. The main body 1 is made of metallic material with good thermal conductivity (e.g. copper) and contains a space 11 for accommodating the LED unit 2. The LED unit 2 and the voltage conversion unit 4 are electrically connected. The voltage conversion unit 4 is configured inside the base 5. The base 5 is connectable to the main body 1. The bottom surface of base 5 is disposed with an electrically conductive pin 51 that matches the projector socket 6 (as shown in FIG. 4). The electrically conductive pin 51 is electrically connected to the voltage conversion unit 4 at one end. The invention is characterized in which the heat-radiating unit 3 is arranged at the outer rim of main body 1 and the heat generated by the LED unit 2 can be effectively transferred to the heat-radiating unit 3 through the main body 1 and then rapidly dissipate, thus enhancing the efficiency of heat dissipation.

In the aforesaid structure, the heat-radiating unit 3 disposed at the outer rim of main body 1 comprises a heat-radiating fin set made of a plurality of L-shaped heat-radiating fins 31 connected in tandem. The short side of each heat-radiating fin 31 of the heat-radiating fin set is in contact with and secured to the outer rim of main body 1, so the long sides of heat-radiating fins 31 radiate outwardly. The heat-radiating fins 31 are made of material with good thermal conductivity, such as cooper or aluminum. In order to replace the conventional halogen projector bulb A by matching the existing projector socket 6, the edges of the long sides of heat-radiating fins 31 can be made to match the shape of projector socket 6. Apparently the design of heat-radiating fin set just described offers greater overall surface area than the outer casing of prior art. Since heat dissipation efficiency is definitively related to the size of surface area, greater surface area undoubtedly would enhance the overall heat dissipation efficiency and effectively address the problem of LED unit lacking adequate brightness for the heat dissipation problem prevents it from using larger wattage LED. Take the example of the prevailing MR-16 specification, LED projector can use at most 1 watt LED unit 2 as constrained by poor heat dissipation performance. With the arrangement of a heat-radiating unit 3, the structure provided by the present invention can install LED unit 2 up to 5 watts without the heat dissipation problem. Thus it can produce better illumination that meets user's needs.

In the present invention, the chain-like heat-radiating fin set 3 made of a plurality of heat-radiating fins 31 connected in tandem by laminating over each other can be mass produced with automated equipment, and can be cut into different lengths based on actual needs to match main body 1 of different diameters. In comparison with the fin structures used in prior art, the present invention not only offers simple and easy fabrication method for the heat-radiating fin set, it also offers greater flexibility when it comes to matching main body 1 of different dimensions and models to help manufacturers reduce production costs, boost profit, and offer more commercially competitive products.

Figure 6:
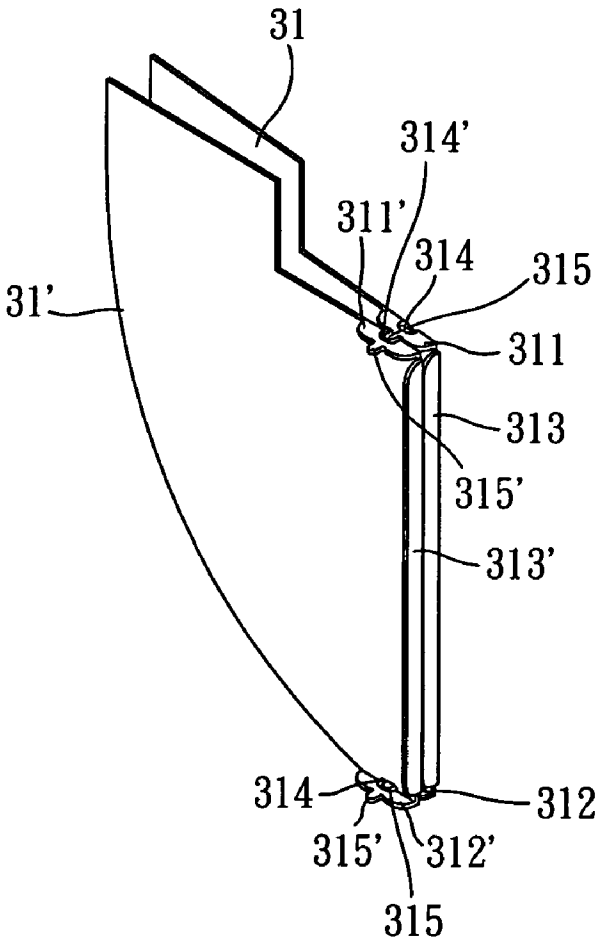
FIG. 6 is an assembled view of heat-radiating fin set according to the invention.
Figure 5:
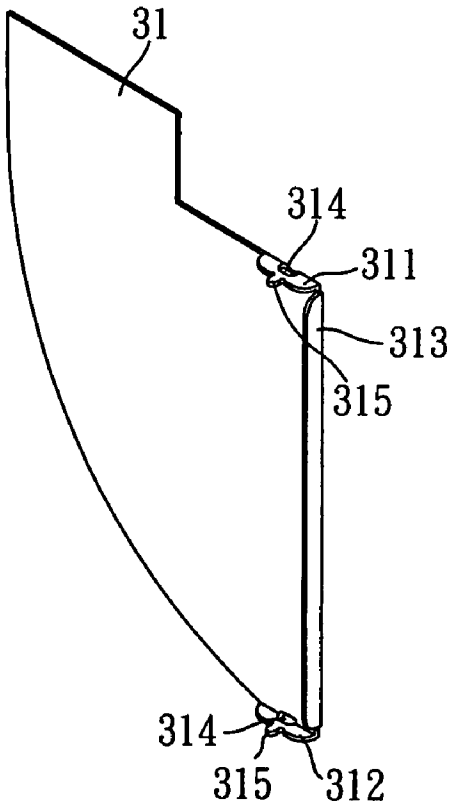
FIG. 5 is an exploded view of the heat-radiating fin set according to the invention.

The chain-like heat-radiating fin set 3 described above is made of heat-radiating fins 31 laminating over each other. Since there are too many examples and variations of laminated structure to describe each one individually, only a preferred embodiment accompanied by figures will be depicted below. Referring to FIG. 5 and FIG. 6 which show respectively an exploded view and an assembled view of the heat-radiating fin set according to the invention, the heat-radiating fin 31 is made of material with good thermal conductivity (e.g. aluminum alloy, copper, silver or gold). It is made by stamping one side of the metal plate to form edgefolds in three different directions—a top edgefold 311, a bottom edgefold 312 and a side edgefold 313. The top edgefold 311 and the bottom edgefold 312 each have fixation hole 314 thereon, and correspondingly, a fixed end 315 is disposed on the outer edge extension of top edgefold 311 and bottom edgefold 312 respectively. Based on the aforesaid structure, the manufacturers, after forming two adjoining heat-radiating fins 31 by stamping, can insert the fixed ends 315 on the outer edge extension of top edgefold 311 and bottom edge 312 of one heat-radiating fin 31 into the fixation holes 314' disposed on the top edgefold 311' and bottom edgefold 312' of the other heat-radiating fin 31' (FIG. 6) to achieve connection and fixation. Through the design of three edgefolds—top edgefold 311, bottom edgefold 312 and side edgefold 313, the fins can be laminated and chained together. On the other hand, the bottom edgefold 312 can increase the heat transfer area between the heat-radiating fin set 3 and base 5, while the side edgefold 313 can increase the heat transfer area between the heat-radiating fin set 3 and the outer rim surface of main body 1. Thus, the contact between the heat-radiating fin set 3 and the main body 1 and the base 5 is "planar" contact through the design of edgefolds 312, 313. That is, the surface area of edgefolds 312, 313 totally overlays the surface of main body 1 to produce "planar" contact between the heat-radiating fin set 3 and main body 1 instead of the "line" contact as seen in prior art. The improved heat transfer efficiency between main body 1 and heat-radiating fin set 3 increases the overall heat dissipation efficiency of the heat-radiating unit as provided.

Figure 7:
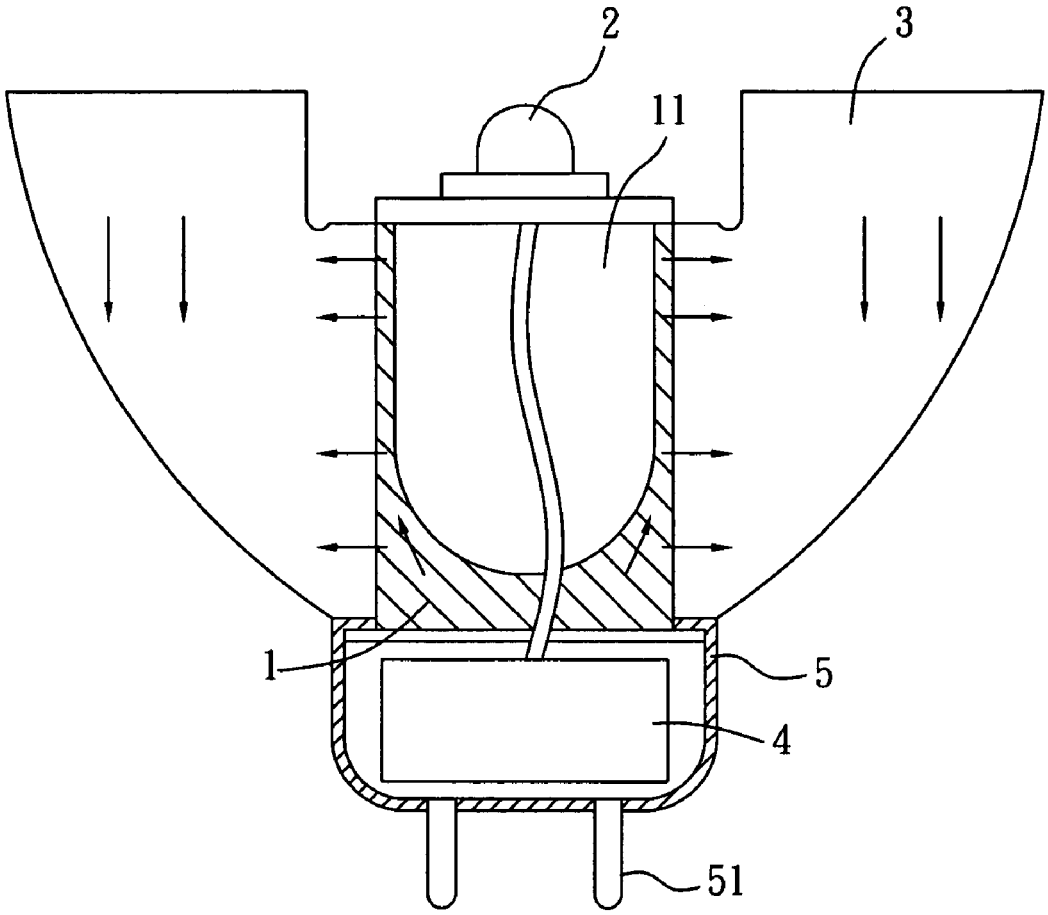
FIG. 7 is a dissection view of the invention.

The space 11 in main body 1 used for accommodating and securing the LED unit 2 is a closed-end cavity that extends axially along a side of main body 1 and tapers (as shown in FIG. 7) towards its bottom.

The components described above are made of copper, silver, gold or metal with excellent thermal conductivity. The bottom of space 11 in main body 1 can be inverted cone shape, inverted spherical shape, or arc cone shape similar to the front end of an inverted bullet.

In the aforesaid structure, the LED unit may be a LED product in different specifications available on the market. With improved heat dissipation performance, the present invention allows the use of larger wattage LED to provide brightness that meets user's needs. As the present invention can provide comparable luminance as conventional halogen projector bulbs, it can replace the latter in commercial applications. In addition, LED has on average up to 100,000 hours of service life. Thus it offers the advantages of energy saving, environmentally friendly and long service life in comparison with conventional halogen light bulbs. The low heat production of the present invention also effectively enhances the safety of the projector lamp and eliminates the fire hazard brought about by high temperature after prolonged use. More so, LED, unlike conventional halogen projector bulb, does not produce ultraviolet radiation to harm eyes and skin, and is thereby safer for users.

The preferred embodiment of the present invention has been disclosed in the example. However the example should not be construed as a limitation on the actual applicable scope of the invention, and as such, all modifications and alterations without departing from the spirits of the invention, for example, modification to the heat-radiating unit or to the shape of heat-radiating fin, shall remain within the protected scope and claims of the invention.

The LED projector light module of the prevent invention features simple structure and easy production. The use of the LED projector light structure according to the invention greatly improves the heat dissipation efficiency of the module, and hence allows the use of LED of larger wattage and greater brightness. As LED can provide comparable luminance as conventional halogen projector light bulbs, while offering the advantages of energy saving and no ultraviolet radiation, it can replace halogen projector light bulbs entirely and allow consumers to save on electricity bill and enjoy safe usage without worrying about the nagging issue of adverse health effect after prolonged use.

Those skilled in the art will readily observe that numerous modifications and alterations of the device may be made while retaining the teachings of the invention. Accordingly, that above disclosure should be construed as limited only by the metes and bounds of the appended claims.

What is claimed is:

1. A LED projector light module, comprising:

a main body made of metallic material of good thermal conductivity and having an accommodation space located at a top of the main body, said accommodation space having a tapering bottom which is in the shape of either a sphere or a rounded cone;

at least an LED unit configured inside a top end of the accommodation space of main body;

a heat-radiating unit disposed at an outer rim of the main body where the heat generated by the LED unit can be effectively transferred to the heat-radiating unit through the main body; said heat-radiating unit being a heat-radiating fin set made of a plurality of L-shaped heat-radiating fins connected in tandem, short sides of the L-shaped heat-radiating fins being disposed with edgefolds in contact with and secured to the outer rim of the main body to increase a contact surface area, and long sides of the heat-radiating fin set radiating outwardly, wherein the short side of each L-shaped heat-radiating fin adjacent to the main body is disposed respectively with the edgefolds extending in three different directions, including a top edgefold, a bottom edgefold and a side edgefold, the side edgefolds substantially forming a surface area to produce a planar contact with the outer rim of the main body, the top edgefold and the bottom edgefold each have respectively a fixation hole thereon, and correspondingly, a fixed end is disposed respectively on outer edge extensions of the top edgefold and the bottom edgefold;

a base connectable to the main body and having an electrically conductive pin at its bottom to match a projector socket, the bottom edgefolds of the L-shaped heat-radiating fins being in contact with the base; and a voltage conversion unit disposed inside the base that is electrically connected to the LED unit and to one end of the electrically conductive pin respectively.

2. The LED projector light module according to claim 1, wherein the outer edge of the long side of said heat-radiating fins can match the shape of projector lamp.

3. The LED projector light module according to claim 1, wherein said heat-radiating fins are made of materials having good thermal conductivity, including copper, aluminum, silver and gold.

4. The LED projector light module according to claim 1, wherein the main body is made of copper, aluminum, silver or gold.

5. The LED projector light module according to claim 1, wherein said heat-radiating fin is made by stamping a plate material.

6. A heat-radiating device for use in a LED projector light module, comprising:

a main body having an accommodation space for accommodating an LED at a top end of the accommodation space, said accommodation space having a tapering bottom which is in the shape of either a sphere or a rounded cone; and a heat-radiating fin set disposed at an outer rim of the main body and contacting the outer rim surface of main body; said heat-radiating unit being a heat-radiating fin set made of a plurality of L-shaped heat-radiating fins connected in tandem, short sides of the L-shaped heat-radiating fins being disposed with edgefolds in contact with and secured to the outer rim of main body to increase a contact surface area, and long sides of the heat-radiating fin set radiating outwardly, wherein the short side of each L-shaped heat-radiating fin adjacent to the main body is disposed respectively with the edgefolds extending in three different directions, including a to edgefold, a bottom edgefold and a side edgefold, the side edgefolds substantially forming a surface area to produce a planar contact with the outer rim of the main body, the top edgefold and the bottom edgefold each have respectively a fixation hole thereon, and correspondingly, a fixed end is disposed respectively on outer edge extensions of the top edgefold and the bottom edgefold.

7. The heat-radiating device according to claim 6, wherein the outer edge of the long side of said heat-radiating fins can match the shape of projector lamp.

8. The heat-radiating device according to claim 6, wherein said heat-radiating fins are made of materials having good thermal conductivity, including copper, aluminum, silver and gold.

9. The heat-radiating device according to claim 6, wherein the main body is made of copper, aluminum, silver or gold.

10. The heat-radiating device according to claim 6, wherein said heat-radiating fin is made by stamping a plate material.

* * * * *